United States Patent [19]

Logsdon

[11] Patent Number: 4,768,741

[45] Date of Patent: Sep. 6, 1988

[54] PIPE HANGERS

[76] Inventor: Duane D. Logsdon, 1708 Calavera Dr., Fullerton, Calif. 92631

[21] Appl. No.: 44,242

[22] Filed: Apr. 30, 1987

[51] Int. Cl.[4] ..... E21F 17/02

[52] U.S. Cl. ..... 248/62; 248/74.3; 248/219.4; 248/231; 24/16 PB; 285/197

[58] Field of Search ..... 248/62, 60, 74.3, 23.1, 248/63, 58, 74.1, 219.4, 230, 231; 24/16 PB, 16 R; 285/197–199

[56] References Cited

U.S. PATENT DOCUMENTS

| | | | |
|---|---|---|---|
| 3,027,130 | 3/1962 | Stumpff | 248/309.1 |
| 3,402,908 | 9/1968 | Gill | 248/231 |
| 3,631,604 | 1/1972 | Schenavar | 248/231 |
| 3,762,743 | 10/1973 | Hawle | 24/280 X |
| 4,121,880 | 10/1978 | Rollins et al. | 248/74.3 |
| 4,665,588 | 5/1987 | Nakano | 248/74.3 |

FOREIGN PATENT DOCUMENTS

| | | | |
|---|---|---|---|
| 899968 | 12/1953 | Fed. Rep. of Germany | 248/74.3 |

OTHER PUBLICATIONS 3 photographs of "Hang 4 Plus" hanger.

*Primary Examiner*—Alvin C. Chin-Shue
*Attorney, Agent, or Firm*—Edward D. O'Brian

[57] ABSTRACT

A pipe hanger can be constructed so as to utilize a central body portion and a separate strap. Both ends of the body portion includes a vertically extending slot; a ratchet structure is provided in one of the body portion slots. The strap is provided with an enlarged head at one of its ends so that it can be dropped through the other of the slots until it is held against further movement by the head engaging the body portion. Ratchet teeth are located on the other end of the strap so that the strap can be wrapped around a pipe and the pipe secured to the body portion by inserting this other end of the strap in the slot having the ratchet structure in the body portion.

6 Claims, 2 Drawing Sheets

PIPE HANGERS

BACKGROUND OF THE INVENTION

The invention set forth in this specification pertains to new and improved pipe hangers. The pipe hangers of the invention are of a type commonly employed in the plumbing and related fields for the purpose of suspending horizontally extending pipes in a fixed or predetermined position. Many different types of pipe hangers have been developed and used to varying extents. This invention is considered to be particularly related to prior pipe hangers as are disclosed in the U.S. Pat. No. 3,523,668.

Pipe hangers as disclosed in this prior patent are constructed so as to include a centrally located, generally cylinderical body portion which is adapted to be secured to the lower end of a specially formed rod or shaft and which is integral with an elongated strap. The strap is such a structure that is capable of being wrapped around a pipe and fastened so as to hold the pipe to the body portion. Pipe hangers constructed in this manner are considered to be both desirable and utilitarian. It is also considered that there are aspects of their construction which are capable of being improved.

In connection with the latter, it is noted that such prior pipe hangers require a specially formed rod or shaft whereas it would be desirable to be able to use a conveniently available, substantially cylindrical rod or shaft instead of such a specially formed part. It is also noted that because of the fact that both the body portion and the strap are integral with one another in such prior hangers that it is impossible to use different straps of different lengths with prior pipe hangers. It is also impossible to form both the strap and the central body portion in such a prior structure so that each is manufactured of a polymer composition which is best suited for use in the body portion or the straps from both an economic and a functional standpoint.

This latter is considered significant because it is normally desired to have the body portion in a hanger of a comparatively rigid, unbending character while inherently the strap used has to be somewhat flexible. In general, these different characteristics are best achieved at a nominal cost using different polymers. In addition, such prior pipe hangers tend to be somewhat undesirably bulky because of the fact that both the body portion and the strap in such hangers are integral with one another. This relates to the size of the packaging needed for use with such prior hangers and items such as shipping costs.

BRIEF SUMMARY OF THE INVENTION

As a result of the preceding considerations, it is believed that it will be apparent that there is a need for new and improved pipe hangers. This invention is intended to provide such pipe hangers. Further, the invention is intended to provide new and improved pipe hangers which may be manufactured at a comparatively nominal cost, which may be easily installed, and which are capable of performing or operating satisfactorily over prolonged, virtually indefinite periods.

The invention is also intended to supply pipe hangers which overcome the various specific disadvantages discussed in the preceding discussion. Thus, it is intended to provide pipe hangers which are of such a character that they do not need specially formed vertical members for support purposes. It is further intended to provide hangers which utilize physically separate bodies and straps so that, if desired, these parts can be formed out of the different polymers. The invention is also intended to provide pipe hangers which occupy comparatively small volumes when stored and shipped. It is further intended to provide pipe hangers in which the central body portion can be used with various different straps of different lengths.

In accordance with this invention these various objectives of the invention are achieved by providing in a pipe hanger having a central body portion including means for use in securing said body portion to the bottom of a vertically extending member and including a strap extending from said body portion for supporting a pipe on said body portion the improvement which comprises: said body portion and said strap being separate parts, said body portion being shaped so as to extend circumferentially around a part of the periphery of a pipe held by said pipe hanger, said body portion having first and second ends which are spaced from one another around the periphery of said pipe when said hanger is used to support said pipe, said first end having a slot formed therein which is adapted to receive said strap and said second end including a ratchet means for engaging said strap, said strap being an elongated strap having an enlarged head on one of its ends and having a series of adjacent ratchet teeth located along its length from the other of its ends generally toward said first end, said strap being capable of extending through said slot to a sufficient extent that said head rest is against said body portion, said other end of said strap being capable of being engaged by said ratchet means so as to secure a pipe against said body portion.

BRIEF DESCRIPTION OF THE DRAWINGS

Because of the nature of this invention it is best described to a further extent than in the preceding with reference to the accompanying drawings in which.

Figure 1:
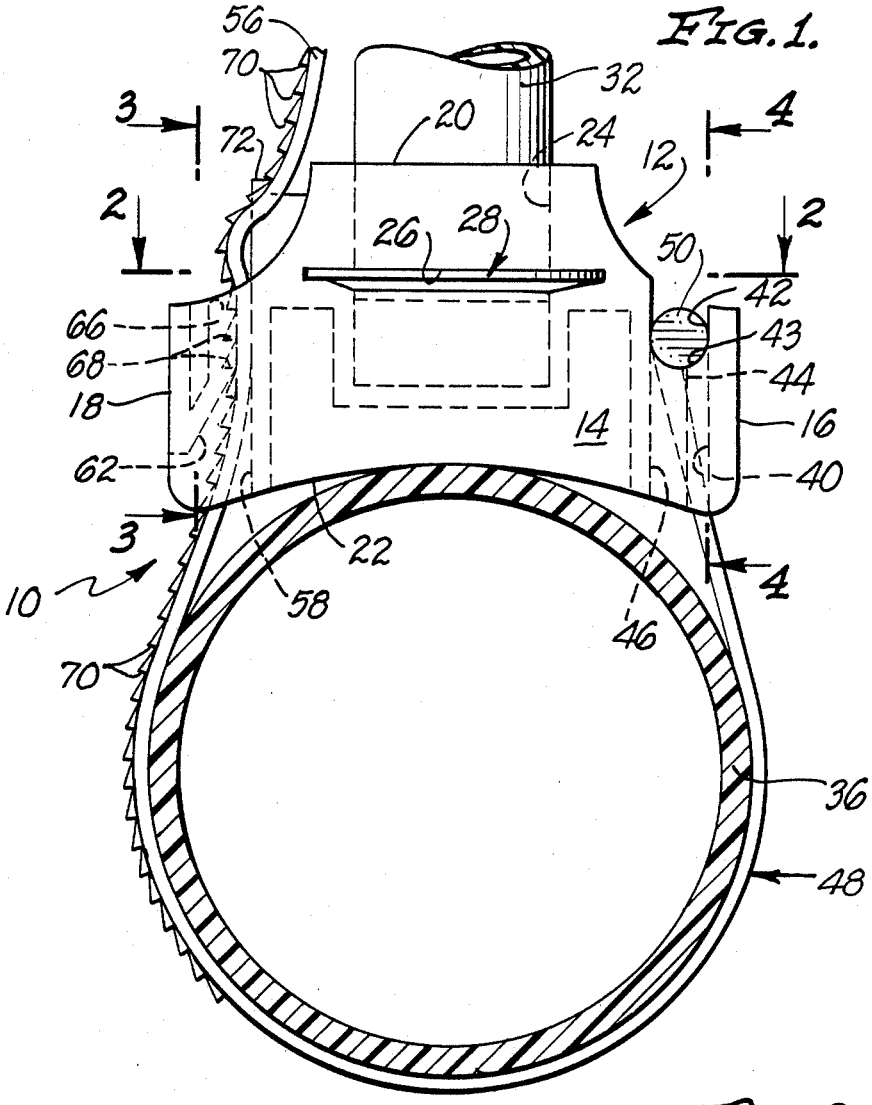
FIG. 1 is a front elevational view of a presently preferred embodiment or form of a pipe hanger in accordance with the invention.
Figure 2:
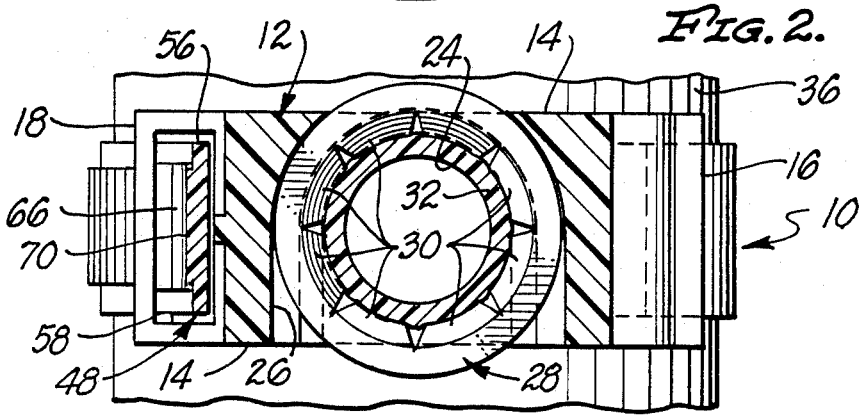
FIG. 2 is a cross-sectional view taken at line 2—2 of FIG. 1.
Figure 3:
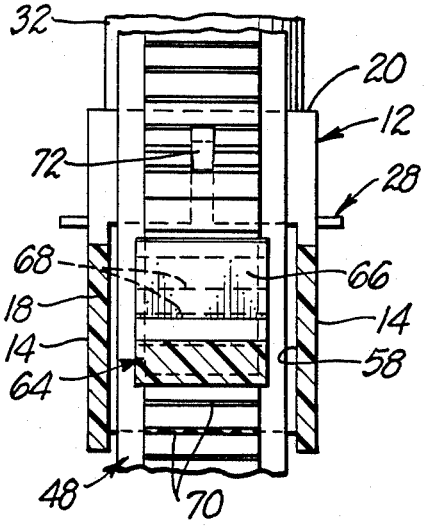
FIG. 3 is a partial cross-sectional view taken at line 3—3 of FIG. 1.
Figure 4:
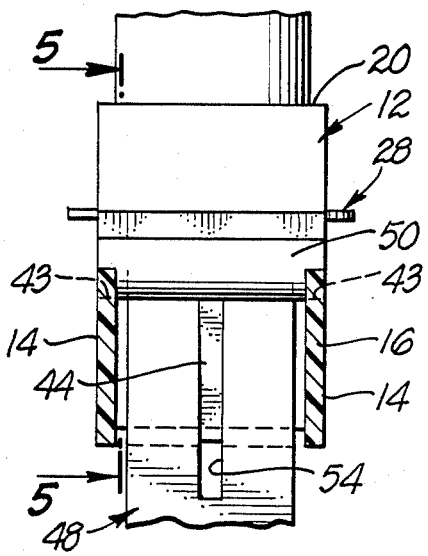
FIG. 4 is a partial cross-sectional view taken at line 4—4 of FIG. 1.

The particular pipe hander (and the parts or modified parts therefore) illustrated in the drawings are designed and constructed so as to use the operative concepts or principles of the invention. The latter are set forth and defined in the appended claims. Those skilled in the design and construction of pipe hangers and related devices as are used in the plumbing and related fields will realize that these concepts and principles can be used in a number of differently appearing and somewhat differently constructed pipe hangers through the use of routine skill in these fields. For this reason the invention is not to be considered as being limited to what is illustrated but is to be considered to be limited only by the scope of the appended claims.

DETAILED OF THE PREFERRED EMBODIMENT

In the drawings there is shown a pipe hanger 10 in accordance with the invention which includes a central body portion 12 shaped so as to include flat, parallel front and rear surfaces 14, first end 16, a second end 18, a top 20 and a somewhat hill or domed shaped bottom 22. This body portion 12 is preferably formed as an integral member by comparatively inexpensive injection molding techniques out of a comparatively rigid, somewhat resilient, self suporting polymer composition such as ABS or other polymers having related physical properties. As formed it includes a cylindrical hole 24 extending vertically downwardly from the top 20 generally towards the bottom 22. Although it is not preferred this hole 24 can extend completely to the bottom 22.

The body portion 12 is also provided with a flat slot 26 which extends into the interior (not separately numbered) of the body portion 12 from only one of the surfaces 14 in such a manner as to cross the hole 24. This slot 26 is adapted to receive a conventional or known metal shaft retainer 28. This retainer 28 is more or less like a bowed or spring washer and includes internal fingers 30 which are capable of resiliently engaging a tubular rod or shaft 32 when this rod 32 is inserted through the hole 24 in the retainer 28 so that the rod 32 cannot be withdrawn.

Both the rod 32 and the retainer 28 or either of them may be considered as part or the hanger 10 or as separate from it. They are employed for the purpose of suspending the hanger 10 and, of course, any pipe 36 held by it. Normally such a pipe 36 will extend horizontally as it is supported against movement by the hanger 10. The bottom 22 may be shaped to fit such a pipe 36 to any desired degree. It is preferred that the bottom 22 be domed as shown so that any such pipe 36 will automatically be centered relative to this bottom 22. The manner in which rod 32 is suspended is immaterial to the concepts of the present invention. Many different ways of mounting the rod 32 are known.

Figure 7:
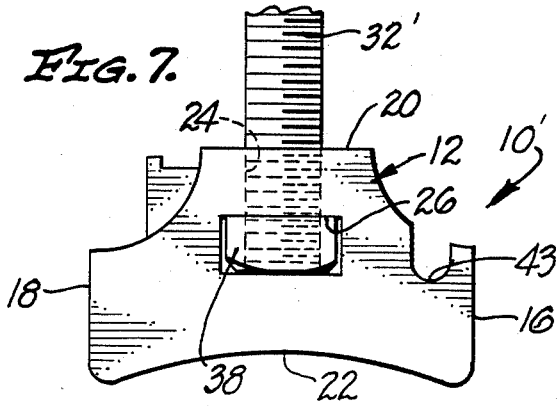
FIG. 7 is a front elevational view of a modified body portion useful in a pipe hanger of the invention, this view including a threaded rod or shaft used to suspend this body portion.

If it is desired to use a threaded rod 32' instead of a non-threaded rod 32 as shown in FIG. 1, the slot 26 may be enlarged slightly so as to receive a common nut 38 used in place of the retainer 28 as indicated in FIG. 7. This type of modified pipe hanger 10' is not considered as preferable as the structure shown in FIG. 1 because it is more difficult and time consuming to thread a rod through a nut that it is to merely jam a rod through a retainer 28 as shown. For convenience of reference, parts of the hanger 10' which are the same as corresponding parts of the hanger 10 are designated by the numerals previously used to distinguish such parts.

Figure 5:
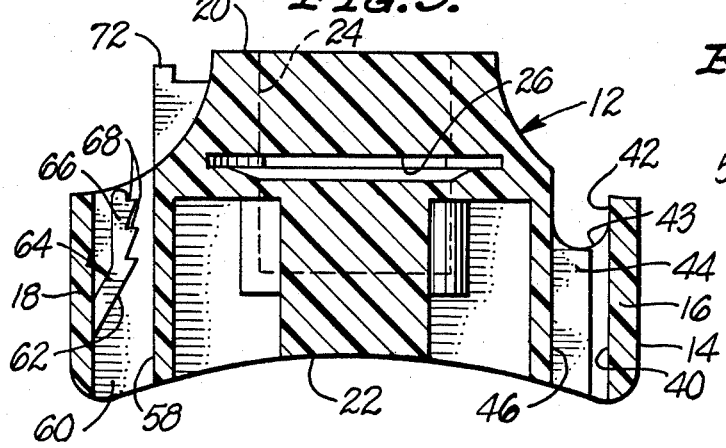
FIG. 5 is a cross-sectional view of only the central body portion of the pipe hanger shown, this view corresponding to a cross-sectional view taken at line 5—5 of FIG. 4.
Figure 6:
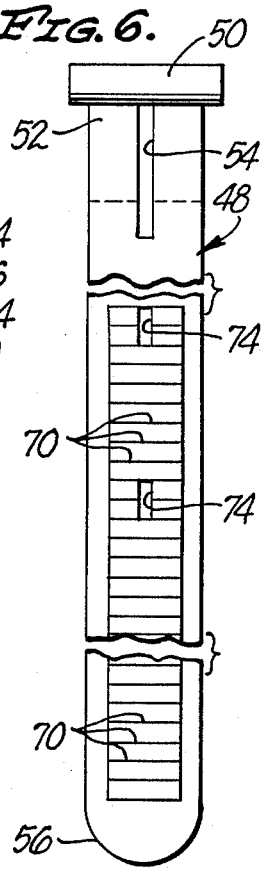
FIG. 6 is an elevational view of the strap used in the complete pipe hanger shown in FIGS. 1–4.

The first end 16 of the body portion 12 includes a vertically extending slot 40 which leads downwardly from a horizontally extending rounded groove 42 having a partially cylindrical bottom 43. The groove 42 is located in this first end 16 adjacent to the top 20. It is provided with a vertically extending ridge or projection 44 located as shown in FIGS. 1 & 5 on a side 46 of the slot 40. An elongated, flexible strap 48 having an enlarged generally cylindrical head 50 corresponding in dimension to the bottom 43 on one of its ends 52 and a longitudinally extending slot 54 extending a short distance along the length of this strap 48 from the head 50 projects through this slot 40. This strap 48 is preferably formed as an integral member out of a somewhat flexible known polymer material by injection molding or other techniques.

When the strap 48 is inserted as shown, the head 50 bears against the end 16 generally around the slot 40 within the groove 42 as shown to as to distribute any force or pull transmitted through it over a cooperatively large area. Because of the shape of the head 50 and that of the groove 42, the illustrated structure will easily accommodate minor movements of the strap 48 as the hanger 10 is being installed. Normally as it is used a slot 54 in the strap 48 will accommodate or receive the projection 44 so as support the head 50 against sagging. This is more or less in the nature of a safety feature; it is considered to be significant.

As used, the strap 48 extends around any pipe 36 secured with or by the use of the hanger 10 as shown so that another end 56 of the strap 48 projects through another slot 58 corresponding to the slot 40. The slot 58 is located in the second end 18 and extends vetically as shown. It includes a somewhat enlarged bottom entrance 60 which tends to direct the end 56 of the strap 48 along and past a tapered wall 62 forming the bottom of an arm 64. This arm 64 is part of the second end 18 and extends into the slot 58 as shown so that a vertical top wall or part 66 of the arm 64 in effect defines a second slot (not separately numbered) within the slot 58. This arm 64 is sufficiently thin so as to be resilient, which is normally thinner than the thickness of the strap 48.

This part 66 has a series of ratchet teeth 68 located as shown so that they will cooperate with other ratchet teeth 70 on the strap 48 adjacent to the end 52 of this strap 48. As a result of this construction the end 56 of the strap 48 can be easily inserted within and then through the slot 58 and then pulled upwardly so as secure a pipe 36 in place against the bottom 22. Because of the action acheived, the ratchet teeth 68 and 70 may be considered as co-acting ratchet means (not separately numbered) for securing the end 56 of the strap 48 in place. The arm 64 is considered as a part of the ratchet means.

As a safety measure it is possible to supplement the action achieved with the ratchet teeth 68 and 70 by the use of an upwardly extending projection 72 on the top 20 of the body portion 12 and by the use of a series of comparatively small slots 74 corresponding to the previously described slot 54. when these optional "parts" 72 and 74 are used, it is possible to fit the projection 72 within a slot 74 on the strap 48 after the teeth 68 and 70 have been engaged as described so the strap 48 is secured to the second end 18. With this type of structure if for any reason the teeth 68 and 70 should not engage with one another the projection will still engage the strap 48 so that there is substantially no danger of the pipe 36 being released.

It is believed that the installation of the hanger 10 and that the manner of securing a pipe 36 to it will be apparent from the preceding discussion. A pipe 36 held by the holder as shown will normally be adequately held for all purposes. If it is necessary or desirable to release a pipe 36 so held, it is possible to physically move the end 56 of the strap 48 so as to dislodge or unhook it from the projection 72 and then to engage the arm 64 so as to move it in such a manner that the teeth 68 and 70 are disengaged. At this point the strap 48 may be easily pulled so that the end 56 is free. Then the holder 10 can be easily moved apart from the pipe 36.

I claim:

1. In a pipe hanger having a central body portion including means for use in securing said body portion to the bottom of a vertically extending member and including a strap extending from said body portion for supporting a pipe on said body portion the improvement which comprises:

said body portion and said strap being separate parts, said body portion being shaped so as to extend circumferentially around a part of the periphery of a pipe held by said pipe hanger, said body portion having first and second ends which are spaced from one another around the periphery of said pipe when said hanger is used to support said pipe, said first end having a slot formed therein which is adapted to receive said strap, and said second end including ratchet means for engaging said strap, said strap being an elongated strap having an enlarged head on one of its ends and having a series of adjacent ratchet teeth located along its length from the other of its ends generally toward said one end, said strap being capable of extending through said slot to a sufficient extent that said head rests against said body portion, said other end of said strap being engaged by said ratchet means so as to secure a pipe against said body portion said head is a cylindrical head, said first end includes a groove having a cylindrical bottom which is chapped so as to correspond to the shape of said head, and said head is located within said groove against said bottom, first interlocking means on said strap adjacent to said head and other on said body adjacent to said slot supporting said head against sagging, second interlocking means on said strap adjacent to said ratchet teeth and on said body adjacent to said ratchet means supporting said strap.

2. In a pipe hanger having a central body portion including means for use in securing said body portion to the bottom of a vertically extending member and including a strap extending from said body portion supporting a pipe on said body portion the improvement which comprises:

said body portion and said strap being separate parts, said body portion being shaped so as to extend circumferentially around a part of the periphery of a pipe held by said pipe hanger, said body portion having first and second ends which are spaced from one another around the periphery of said pipe when said hanger is used to support said pipe, said first end having a slot formed therein which is adapted to receive said strap, and said second end including ratchet means for engaging said strap, said strap being an elongated strap having an enlarged head on one of its ends and having a series of adjacent ratchet teeth located along its length from the other of its ends generally toward said one end, said strap being capable of extending through said slot to a sufficent extent that said head rests against said body portion, said other end of said strap being engaged by said ratchet means so as to secure a pipe against said body portion said head is a cylindrical head, said first end includes a groove having a cylindrical bottom which is chapped so as to correspond to the shape of said head, and said head is located within said groove against said bottom, said strap includes a slot formed therein adjacent to said head, said body includes projection means extending into said slot adjacent to said groove, and said projection means fits within said slot so as to further support said head.

3. In a pipe hanger having a central body portion including means for use in securing said body portion to the bottom of a vertically extending member and including a strap extending from said body portion for supporting a pipe on said body portion the improvement which comprises;

said body portion and said strap being separate parts, said body portion being shaped so as to extend circumferentially around a part of the periphery of a pipe held by said pipe hanger, said body portion having first and second ends which are spaced from one another around the periphery of said pipe when said hanger is used to support said pipe, said first end having a slot formed therein which is adapted to receive said strap, and said second end including ratchet means for engaging said strap, said strap being an elongated strap having an enlarged head on one of its ends and having a series of adjacent ratchet teeth located along its length from the other of its ends generally toward said one end.

said strap extending through said slot to a sufficient extent that said head rests against said body portion, said other end of said strap being capable of being engaged by said ratchet means so as to secure a pipe against said body portion, said second end of said body portion includes a projection located above and adjacent to said ratchet means on said second end and said other end of said strap includes slot means engaging said projection when said ratchet means are in engagement so as to hold said strap relative to second end in the event said ratchet means do not secure said strap to said second end.

4. A pipe hanger as claimed in claim 3 wherein:

said head is a cylinderical head, said first end includes a groove having a cylindrical bottom which is chapped so as to correspond to the shape of said head, and said head is located within said groove against said bottom, said second end includes a vertically extending slot and said ratchet means on said second end are located within said slot in said second end.

5. A pipe hanger as claimed in claim 4 wherein:

said strap includes a slot formed therein adjacent to said head, said body includes projection means extending into said slot adjacent to said groove, and said projection means fits within said slot so as to further support said head.

said ratchet means on said second end include a series of ratchet teeth capable of engaging said ratchet teeth on said strap.

6. A pipe hanger as claimed in claim 5 wherein:

said ratchet means on said second end includes a resilient arms located within said slot and said ratchet teeth on said second end are located on said arm, said resilient arm is shaped so that said top wall defines a second slot within said first mentioned slot which is thinner than the thickness of said strap through which said other end of said strap is moved during the assembly of said pipe hanger.

* * * * *